US009689635B2

(12) United States Patent
Krieger

(10) Patent No.: US 9,689,635 B2
(45) Date of Patent: Jun. 27, 2017

(54) DEVICE FOR PREVENTING THE TENSIONING OF A FIRING PIN SPRING IN THE DISARMING OF A HAMMERLESS SELF-LOADING PISTOL PROVIDED WITH A LOCK SLIDE AND A SELF-LOADING PISTOL WITH SUCH A DEVICE

(71) Applicant: HECKLER & KOCH GMBH, Oberndorf (DE)

(72) Inventor: Hubert Krieger, Messkirch-Rengetsweiler (DE)

(73) Assignee: HECKLER & KOCH GmbH, Obemdorf (DE)

( * ) Notice: Subject to any disclaimer, the term of this patent is extended or adjusted under 35 U.S.C. 154(b) by 0 days.

(21) Appl. No.: 15/107,441

(22) PCT Filed: Nov. 28, 2014

(86) PCT No.: PCT/EP2014/003194
§ 371 (c)(1),
(2) Date: Jun. 22, 2016

(87) PCT Pub. No.: WO2015/096881
PCT Pub. Date: Jul. 2, 2015

(65) Prior Publication Data

US 2016/0320154 A1 Nov. 3, 2016

(30) Foreign Application Priority Data

Dec. 23, 2013 (DE) ..... 10 2013 022 080

(51) Int. Cl.
*F41A 5/00* (2006.01)
*F41A 17/64* (2006.01)
(Continued)

(52) U.S. Cl.
CPC ..... *F41A 17/64* (2013.01); *F41A 11/00* (2013.01); *F41A 17/00* (2013.01); *F41A 19/32* (2013.01); *F41C 3/00* (2013.01)

(58) Field of Classification Search
CPC ..... F41A 17/64; F41A 17/00; F41A 11/00; F41A 19/32; F41C 3/00
(Continued)

(56) References Cited

U.S. PATENT DOCUMENTS 2,464,427 A * 3/1949 Wilson ..... F41A 19/48 89/139
3,128,570 A * 4/1964 Browning ..... F41A 17/74 42/70.01
(Continued)

FOREIGN PATENT DOCUMENTS

DE 3536125 5/1986
EP 1022535 7/2000
(Continued)

OTHER PUBLICATIONS

International Searching Authority, English translation of the International Preliminary Examination Report, Issued in connection with International Application No. PCT/EP2014/003194, mailed Jul. 7, 2016, 8 pages.
(Continued)

*Primary Examiner* — Samir Abdosh
(74) *Attorney, Agent, or Firm* — Hanley, Flight & Zimmerman, LLC

(57) ABSTRACT

The invention relates to a device for prevention of the tensioning of a firing pin spring in the disarming of a hammerless self-loading pistol (1) provided with a lock slide (7), wherein the device can assume a disarming position and a locking position, with: a spring-loadable firing pin (17) with a lug (17*a*) formed on it for active engagement with a
(Continued)

sear (19), which in the cocking position for cocking the firing pin spring protrudes into the path of motion of the lug (17*a*) and in the disarming position is disengaged from the lug (17*a*), a trigger bar (27) coupled with a trigger which in the disarming position disengages the sear (19) from the lug (17*a*), and is characterized by a disarming shaft (15), which in the disarming position enables a movement of the trigger (5) and thus the trigger bar (27) to the front, and a disconnector bar (21) that can be coupled to the trigger bar (27), said disconnector bar being impacted in the disarming position by the lock slide (7) moved to the front and as a result operatively disengaging the sear (19) from the lug (17*a*) by means of the trigger bar (27). The invention also relates to a self-loading pistol equipped with such a device.

13 Claims, 17 Drawing Sheets

(51) Int. Cl.

| | |
|---|---|
| ***F41A 11/00*** | (2006.01) |
| ***F41A 17/00*** | (2006.01) |
| ***F41A 19/32*** | (2006.01) |
| ***F41C 3/00*** | (2006.01) |

(58) Field of Classification Search
USPC ..... 89/144, 132, 139
See application file for complete search history.

(56) References Cited

U.S. PATENT DOCUMENTS

| | | | | | |
|---|---|---|---|---|---|
| 3,750,531 | A * | 8/1973 | Angell | F41A 17/64 | 42/70.08 |
| 3,857,322 | A * | 12/1974 | Lichtman | F41A 3/82 | 42/15 |
| 5,157,209 | A * | 10/1992 | Dunn | F41A 17/64 | 42/70.08 |
| 5,386,659 | A * | 2/1995 | Vaid | F41A 19/32 | 42/69.02 |
| 7,096,618 | B2 * | 8/2006 | McGarry | F41A 17/36 | 42/70.02 |
| 7,810,268 | B1 * | 10/2010 | McGarry | F41A 11/00 | 42/69.01 |
| 7,827,720 | B1 * | 11/2010 | Erdem | F41A 17/42 | 42/70.01 |
| 2010/0236121 | A1 * | 9/2010 | McGarry | F41A 11/00 | 42/69.02 |
| 2011/0126441 | A1 | 6/2011 | Vukovic | | |
| 2011/0289811 | A1 * | 12/2011 | Gentilini | F41A 17/72 | 42/69.02 |

FOREIGN PATENT DOCUMENTS

| | | |
|---|---|---|
| EP | 2294352 | 3/2011 |
| GB | 2165627 | 4/1986 |
| WO | 2009149951 | 12/2009 |
| WO | 2009156774 | 12/2009 |

OTHER PUBLICATIONS

International Searching Authority, "International Search Report and Written Opinion", issued in connection with PCT Patent Application No. PCT/EP2014/003194, mailed on Feb. 5, 2015, with English Translation, 28 pages.

German Patent Office, "Office Action", issued in connection with German Patent Application No. 10 2013 022 080.7, issued on Feb. 14, 2014, with English Translation, 16 pages.

* cited by examiner

DEVICE FOR PREVENTING THE TENSIONING OF A FIRING PIN SPRING IN THE DISARMING OF A HAMMERLESS SELF-LOADING PISTOL PROVIDED WITH A LOCK SLIDE AND A SELF-LOADING PISTOL WITH SUCH A DEVICE

CROSS-REFERENCE TO RELATED APPLICATIONS

This patent is a National Stage filing of PCT/EP2014/003194, filed Nov. 28, 2014, which claims the benefit of German Application 10 2013 022 080.7, filed Dec. 23, 2013. PCT Application Number: PCT/EP2014/003194 and German Application Number: 10 2013 022 080.7 are incorporated by reference herein in their entirety.

The invention relates to a firing pin spring tensioning prevention device, to be more precise, a device for prevention of the tensioning of a firing pin spring in the disarming of a hammerless self-loading pistol provided with a lock slide. Such a device can assume a locking position or cocking position and a disarming position and has a spring-loadable firing pin with a lug formed on it for active engagement with a sear, which in the cocking position for cocking the firing pin spring protrudes into the path of motion of the lug and in the disarming position is disengaged from the lug, and a trigger bar coupled with a trigger which in the disarming position disengages the sear from the lug.

The invention also relates to a self-loading pistol which is equipped with such a device.

In these documents positional terms such as "above", "below", "front", "rear" always refer to the perspective of a shooter who is holding the self-loading pistol in normal firing position with horizontally running axis of the bore.

PRIOR ART

Self-loading pistols with a device for preventing the tensioning of the firing pin spring in the disarming of these pistols are known in different designs. Such a device serves the purpose of preventing an unintentional firing in the disarming of the self-loading pistol, for example for the purpose of cleaning it or checking its technical condition. It is also known to uncock the trigger system via an additional controller, such as a decocking lever, or simply by having it triggered by actuation of the trigger.

Further, hammerless self-loading pistols—also called pistols with a firing pin lock—are known. In the cocking and rotating of the cylinder of these pistols the lock slide is released from its rear position and the recoil spring drives the lock slide forward. In the process the firing pin is caught by a sear—also called a trigger lever—in the grip and therefore cannot glide to the front with the lock slide. The advancing lock slide in the processes compresses the firing pin spring inside of it. When the shooter then actuates the trigger mechanism in the grip, it releases the pre-stressed firing pin. On the other hand, in a double-action trigger system the actuation of the trigger in addition to the firing pin release function can tension the firing pin spring either completely or partially.

To disarm such a hammerless self-loading pistol a shooter ordinarily holds the pistol with one hand on the body of the grip and encompasses with the other hand the lock slide or the upper part of the lock from above. Then the shooter pulls the lock slide to the rear, against the spring force of the recoil spring arranged in the grip, until a slide catch lever catches, that is holds the lock slide in its slide catch position. A cartridge present in the cartridge chamber will be ejected in the event of retraction of the lock slide.

In the catch position of the lock slide a disarming lever or a disarming shaft can be rotated via an outer handle from its locking position to its disarming position. In its locking position the disarming shaft blocks a lug on the underside of the barrel, so that the barrel cannot be removed. In the disarming position this lug can glide over the disarming shaft and the pistol can be taken apart in the usual manner. After release of the lock slide by means of an actuation of the slide catch lever the lock slide can then be pulled forward together with the barrel and the recoil spring.

If hammerless pistols are disarmed without corresponding safety devices in the case of an installed loaded magazine, a cartridge from the magazine is fed to the cartridge chamber and the firing pin spring is tensioned. Namely, in the event of retraction of the lock slide it glides across the magazine and frees up space above the magazine. A magazine spring then pushes a cartridge from the magazine above into the path of motion of the lock slide. In the case of the advancement or guided forward sliding of the lock slide from its catch position it engages, driven by the spring force of the recoil spring, the cartridge with its underside, to be more precise, its cartridge bottom, and pushes the cartridge to the front into the cartridge chamber. If there is no device for preventing the tensioning of the firing pin spring in the disarming, a sear catches and holds the firing pin during the forward motion of the lock slide. The lock slide, which continues to glide forward, then tensions the firing pin spring. If the user unlocks the sear to the front by pressing the trigger and releasing the firing pin to remove the slide, in such cases a shot is triggered unintentionally in the disarming.

EP 1 022 535 A2 discloses a hammerless self-loading pistol with a trigger mechanism in which case in a cocking position a catch member protrudes into the path of motion of a catch nose formed on the firing pin. The catch member is formed on the upper side of an insert provided in the rear part of the handle. The insert comprises a spring-loaded pawl, which is guided via pins in oblong holes proceeding transverse to the rear.

During the cocking and rotating of the cylinder the catch nose impacts the catch member in the case of a movement of the lock slide to the rear, in the process pressing the pawl against the force of a spring downward to the rear, until the catch nose can glide across the catch member. In the subsequent forward movement of the lock slide due to the recoil spring releasing from its rear position, the catch member catches and holds the catch nose, whereby the lock slide, which continues moving forward, pretensions the firing pin spring. The pistol is then ready to fire.

In the trigger actuation a trigger rail impacts the pawl and pushes it downward to the rear until the catch member disengages from the catch nose and releases the firing pin, so that a shot is discharged. In the case of the subsequent gliding back of the lock slide the pawl swivels back to its cocked position, A control lever is provided for disarming of the pistol whose outer handle can be rotated to a disarming position. In the process a pin is lowered in one of the oblong holes in the pawl, so that the pawl and the catch member move out of the path of motion of the catch nose. After pulling a bolt by means of a disassembly lever the lock slide can be pulled to the front.

EP 2 294 352 A2 discloses a further mechanism for disarming of a handheld firearm without tensioning the firing pin spring. In a cocked position of the mechanism the trigger bar protrudes into the path of motion of a lug on the firing pin and catches and holds it. An eccentrically pivoted disarming lever and a trigger bar catch lever that can be moved horizontally by said disarming lever are provided for actuation of a spring-loaded trigger bar catch member. In the case of the rotation of the disarming lever it moves the trigger bar catch lever to the rear and in the process rotates the trigger bar catch lever so that it catches neither the trigger bar nor the firing pin, instead being held out of the path of motion of the lug on the firing pin. Now the slide can be moved to the front from the grip, without the firing pin spring being tensioned.

PROBLEM AND SOLUTION OF THE INVENTION

The invention addresses the problem of providing a different device for preventing the tensioning of a firing pin spring in the disarming of a self-loading pistol as well as a self-loading pistol equipped with said device.

This problem is solved by the subject matters of independent claims 1 and 13.

Hence, according to claim 1 the generic device has the following features: a disarming shaft, which in the disarming position enables a movement of the trigger and thus the trigger bar to the front, and a disconnector bar that can be coupled to the trigger bar, said disconnector bar being impacted in the disarming position by the lock slide moved to the front and as a result operatively disengaging the sear from the lug by means of the trigger bar.

The category-defining self-loading pistol of claim 13 is characterized by the fact that it is provided with a device according to any one of claims 1 through 12.

Thus, a disassembly of an inventive pistol is only possible when its disarming shaft is in its disarming position, so that the sear moves from the path of motion area of the lug on the firing pin. Thus the device ensures a danger-free disarming, since in its disarming position the firing pin spring is not cocked and therefore a round also cannot be discharged. Moreover, a disarming is only possible when the user consciously releases the operating mechanism of the device in several sequential steps, namely: 1. Removal of the magazine, 2. Pulling back the lock and manual engagement of the slide catch lever, 3. Rotation of the disarming shaft for disarming, 4. Holding of the lock and release of the slide catch lever, 5. Guided removal of the lock with barrel and recoil spring to the front, so that an unintentional disarming is prevented. In other respects, the assembly of the pistol occurs in the reverse order of these steps.

Due to the comparatively simple and robust technology with translationally or vertically moved components that are unsusceptible to soiling, the device is less prone to failure. This is the case even with severe mechanical loads from the outside, so that the functional safety and reliability of the self-loading pistol are given.

Preferably a stop is provided on the trigger of the device and the disarming shaft has a preferably wedge-shaped recess or a section with reduced diameter, on which the stop of the trigger rests spring-loaded in the disarming position in the event of a rotated disarming shaft (Claim 2).

The spring-loaded location of the stop on the trigger at the section with reduced diameter of the disarming shaft is permanent, wherein the reduced diameter forms a continuous sloping guide, which falls in the disarming direction of the shaft and rises in the locking direction of the shaft, so that the trigger and the trigger bar move to the front in the disarming position of the shaft and move to the rear in the locking direction of the shaft.

Preferably, in its locking position the disarming shaft prevents a movement of the stop and thus of the trigger as well as of the trigger bar to the front. (Claim 3).

In a production engineering simple embodiment the disarming shaft comprises a region of greater diameter, which in the case of a rotated disarming shaft in its locking position faces the stop and therefore blocks its forward motion. Thus, in its locking position the disarming shaft ensures a tensioning of the firing pin spring of the self-loading pistol, since the sear is on the firing pin in the movement region of the lug.

Preferably, the forward movement of the trigger bar enables its forced engagement with the disconnector bar and the sear (Claim 4).

To this end the connector bar can be provided with at least one active element, which goes into active engagement with the disconnector bar.

The trigger bar can be equipped for the forced engagement for example with a projection, pin or another implementation with suitable geometry.

Preferably the trigger bar is provided with at least one tab for the forced engagement (Claim 5).

A tab can be easily provided by means of production engineering, for example via a forming of a part of the trigger bar. In the case of a parallel arrangement of the trigger bar and the disconnector bar the tab can grip the disconnector bar from below. Also a second tab can be designed for an active engagement with the sear. The applicant reserves the right to claim separate protection for such a trigger bar.

Preferably the sear has a projection for the active engagement with the trigger bar (Claim 6).

The projection can for example be provided as a trunnion, pin or bolt arranged on the sear or inserted in it, or also as another implementation with suitable geometry. The trigger bar can comprise a second active element, for example a second tab, which can be brought into active engagement with the projection. In terms of movement, the above components interact simply.

Preferably the disconnector bar comprises a step for the active engagement with the trigger bar in a recess (Claim 7).

The recess and the step can be produced with simple means, for example by punching, milling or otherwise. The tab of the trigger bar engages in the recess.

Preferably the disconnector bar comprises an elevation on its side facing the lock slide and can be impacted upon it through a lower contour of the moving lock slide (Claim 8).

This measure provides with mechanically simple means an effective control cam which makes its actuation possible only upon active engagement of the elevation with the underside of the lock slide.

Preferably the lock slide comprises on its underside a first recess, which in the case of a closed lock can be brought into active engagement with the elevation of the disconnector bar (Claim 9).

Preferably the lock slide comprises on its underside at least a second recess which in its slide catch position can be brought into active engagement with the elevation of the disconnector bar (Claim 10).

The first and second recess each prevent an impacting of the disconnector bar, when the elevation of the disconnector bar is immersed into one of the recesses.

Preferably, a non-recessed region on the underside of the lock slide in its forward movement from its slide catch position presses the disconnector bar downward, said disconnector bar in the process going into form-fitting or forced engagement with the trigger bar, bringing said trigger bar into form-fitting or forced engagement with the sear and the trigger bar brings the sear out of the path of motion of the firing pin (Claim 11).

Preferably the device comprises a release pawl, which upon actuation of the trigger can be coupled with the trigger bar and thus disengaging the sear from the lug to discharge a round (Claim 12).

This measure ensures firing in the cocked position.

Exemplary embodiments of the invention are described in greater detail in the following with reference to the attached schematic drawings. The figures show the following:

FIGS. 1 through 4 show the functional sequence of the disarming of a hammerless self-loading pistol 1 and FIGS. 5 through 8 show the individual elements of the pistol 1 before, during and after firing a round. The structure and function of the device for preventing a tensioning of the firing pin spring during the disarming of the pistol 1 are explained with the assistance of FIGS. 9 through 17.

Figure 1:
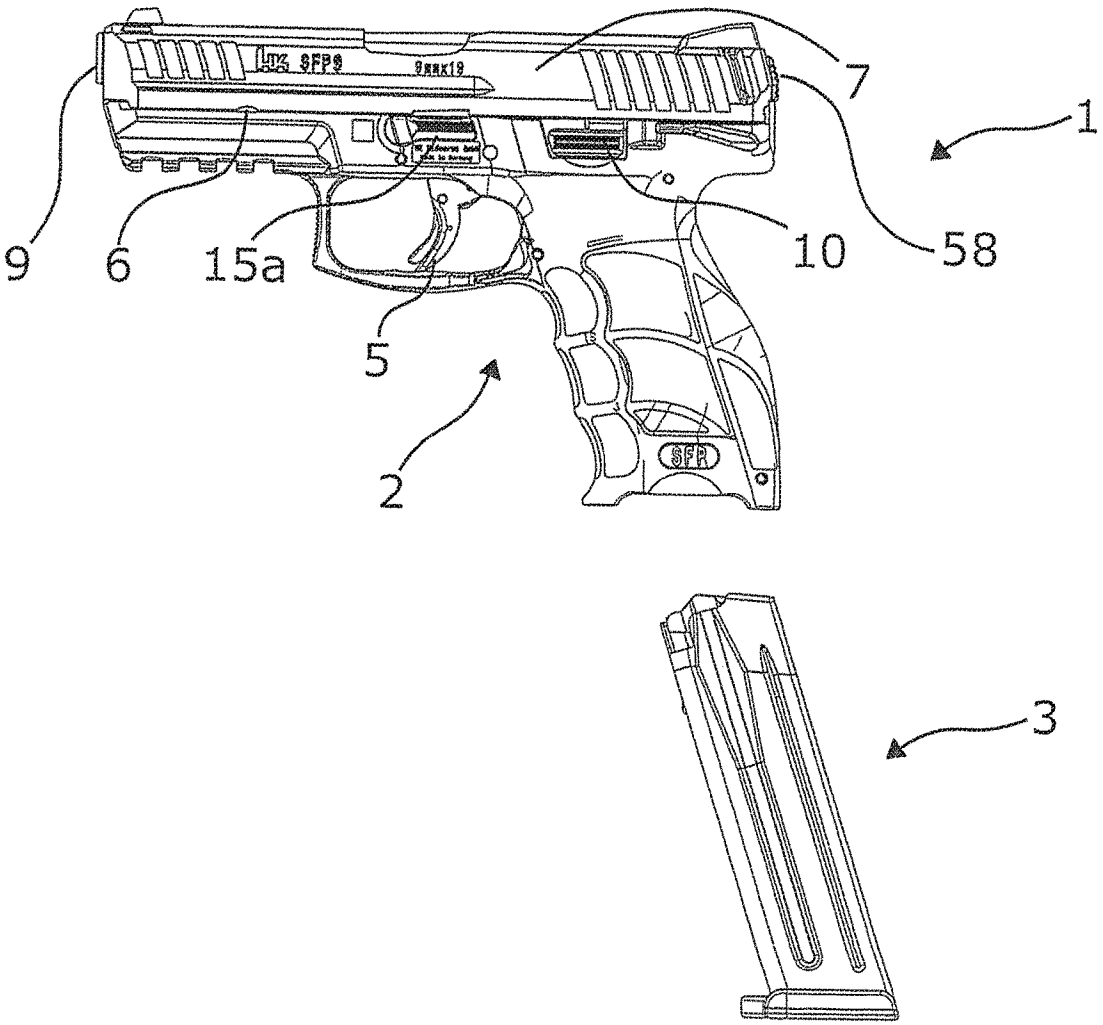
FIG. 1 shows a self-loading pistol and a magazine removed from it in lateral view.

FIG. 1 shows in exterior view a self-loading pistol 1 in assembled state but with a removed magazine 3. The self-loading pistol 1 comprises a grip 2 and a lock slide 7 surrounding a barrel 9. A trigger mechanism shown in FIGS. 5 through 17 can be actuated in known manner via a trigger 5. By means of an exterior handle 15*a* a disarming shaft 15 that cannot be seen here, shown in FIGS. 9 through 17 arranged in the grip 2 can be rotated in a locking position or in a disarming position.

The handle 15*a* points horizontally to the rear in the locking position, also called the cocking position. In the process, among other things it blocks a lug 12 on the underside of the barrel 9 (cf. FIG. 4), and thus prevents a removal of the barrel 9. In the disarming position the handle 15*a* points downward (see FIGS. 3 and 4). In this position the barrel 9 and the lock slide 7 as well as the recoil spring assembly 39 can be pulled forward from the grip 2 after release of an in and of itself known slide catch lever 10, since the lug 12 can glide over the disarming shaft 15. Such a disarming shaft is described for example in DE 10 2013 010 969.8 of the applicant of the same name, to which reference is explicitly made here.

Figure 2:
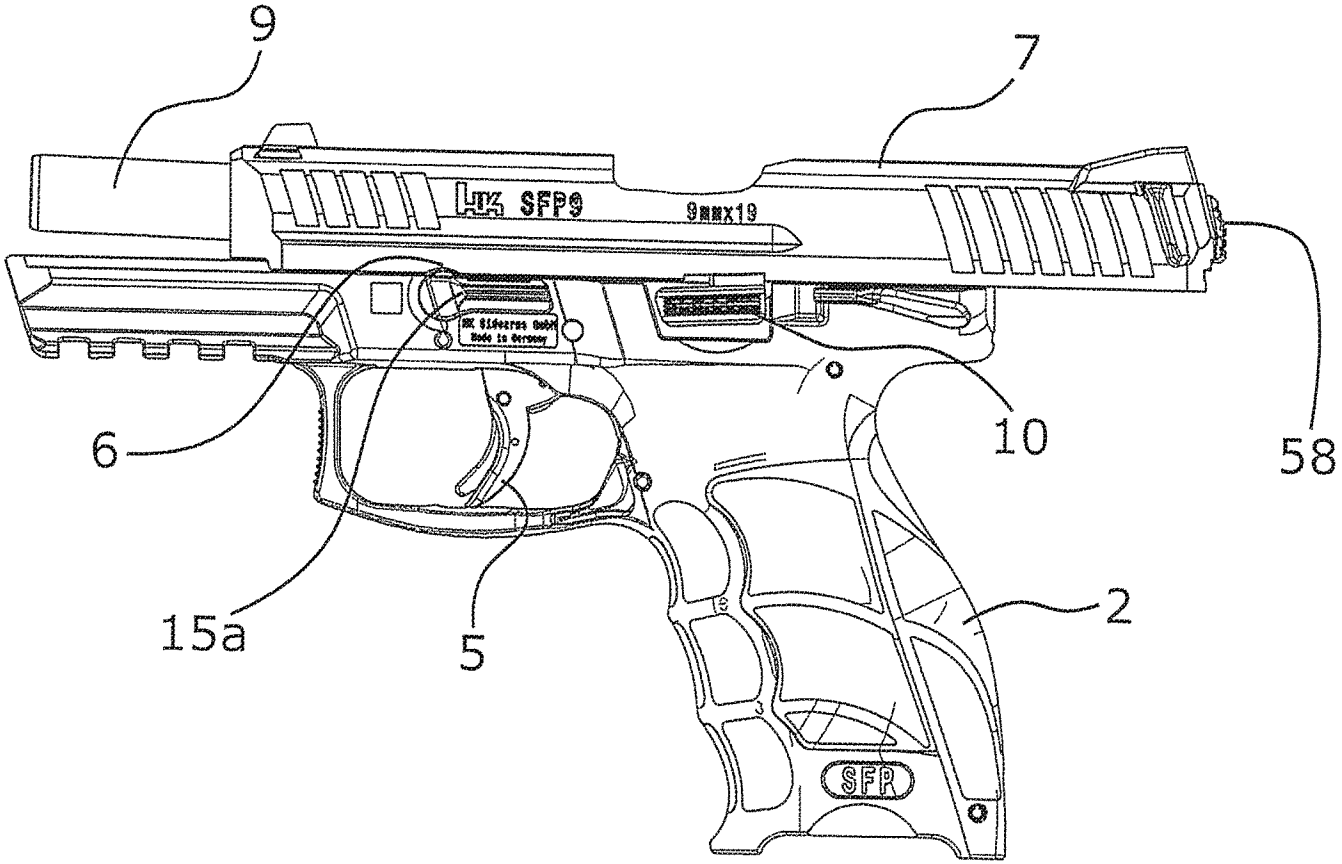
FIG. 2 shows the self-loading pistol according to FIG. 1 with its retracted lock slide in its slide catch position and its disarming shaft in its locking position.

The slide catch lever 10 catches and holds in known manner the lock 7 in its slide catch position (cf. FIG. 2). On the lock slide underside a half-round recess 6 is provided, which is positioned such that it only enables a rotation of the disarming shaft 15 in the slide catch position in its cocking or disarming position—and only when the magazine 3 has been previously removed.

FIG. 2 shows the self-loading pistol 1 with retracted lock slide 7 in an open slide catch position held by the slide catch lever 10. In the case of the retraction of the lock slide 7 in its slide catch position any cartridge remaining in the cartridge chamber will be ejected. The disarming shaft 15 is in its locking position.

Figure 3:
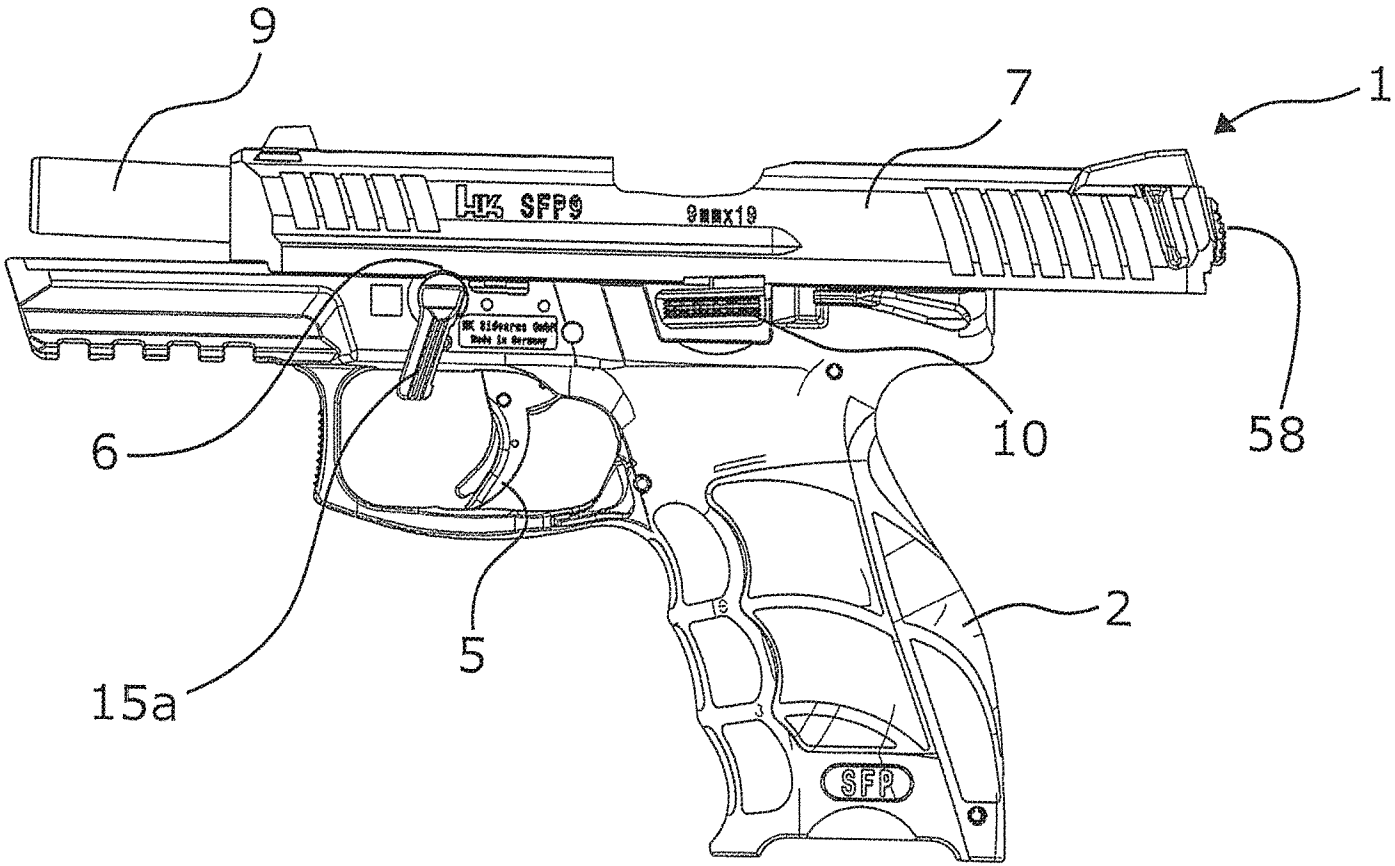
FIG. 3 shows the self-loading pistol according to FIG. 2 with its disarming shaft in disarming position.
Figure 4:
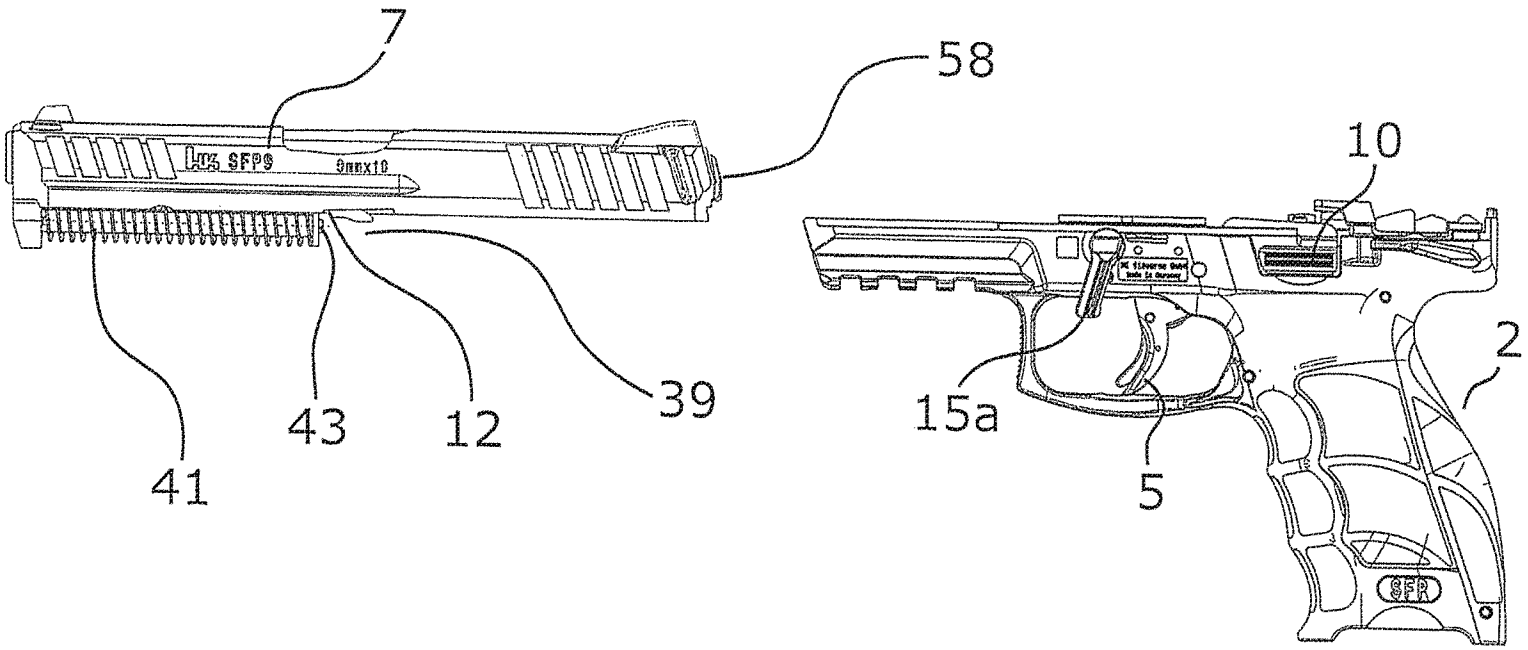
FIG. 4 shows the self-loading pistol disarmed in its lock slide with barrel and recoil spring and its grip.

In the representation in FIG. 3 the disarming shaft 15 is rotated clockwise by means of the handle 15*a* now pointing downward. This is only possible in the slide catch position, in which the disarming shaft 15 is in the semicircular recess 6 on the lock slide underside; moreover only in the case of the removed magazine, thus an empty magazine compartment.

Figure 5:
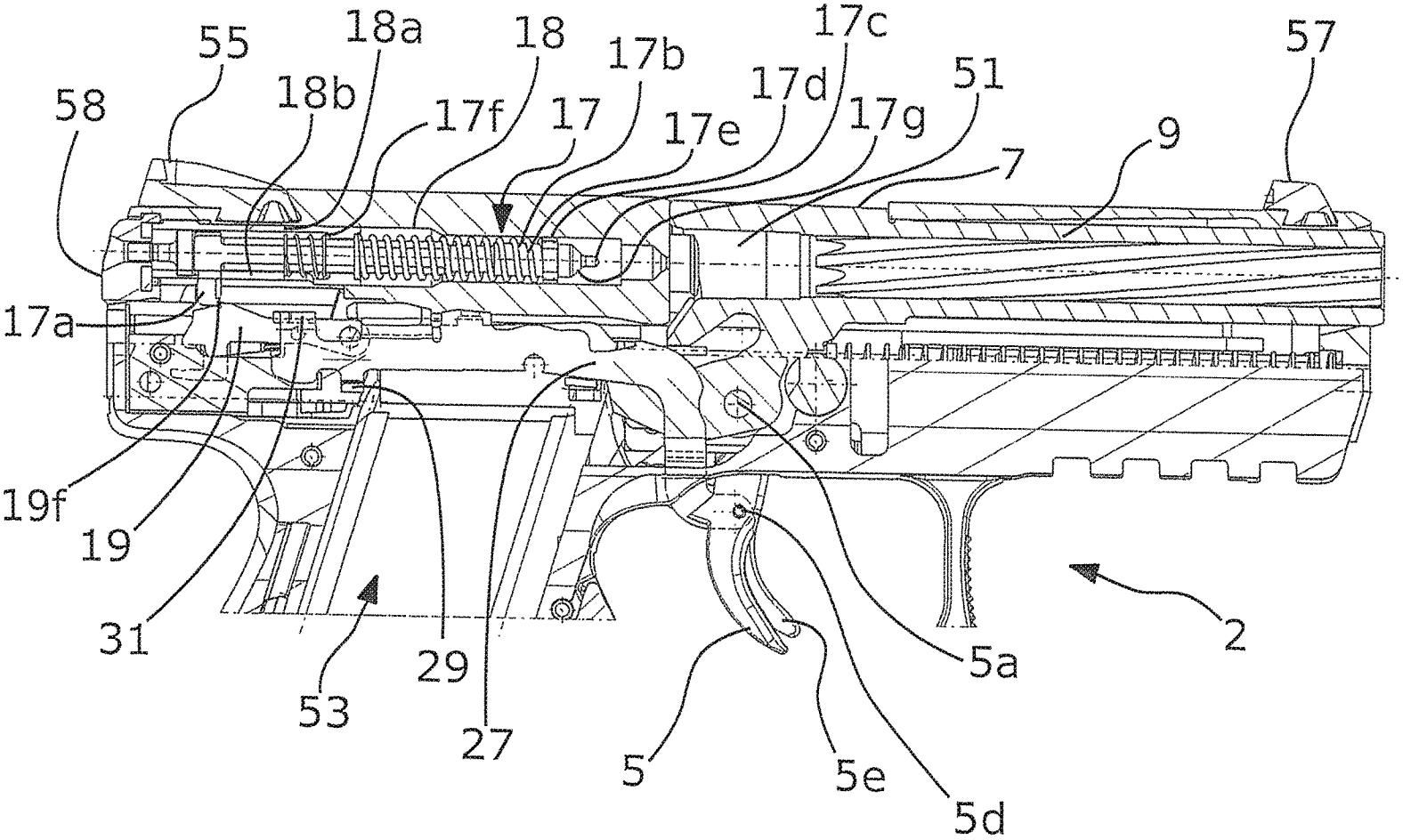
FIG. 5 shows the self-loading pistol according to FIGS. 1 through 4 with a firing pin caught by the sear, cocked firing pin spring and secured and uncocked trigger in sectional view.

FIG. 5 shows the pistol 1 with cocked firing pin prior to its release and firing. As is known, the following elements are provided for firing: the trigger 5, the trigger safety 5*e*, a trigger bar 27 coupled with the trigger 5, a release pawl 45 (see FIGS. 6 and 7), a sear 19, the firing pin 17 with a lug 17*a* and the lock slide 7. The structure of these components and their interaction will be described in the following.

The trigger 5 is pivotably mounted around a trigger shaft 5*a* and pre-stressed by a torsion spring 5*b* (cf. FIG. 7) and a spring 37 (cf. FIG. 11) in its resting position shown in FIG. 5. The trigger 5 comprises on its rear side a lug 5*c* (cf. in particular FIG. 9). This lug 5*c* serves as a cover, in order to make penetration of dirt and foreign bodies via the trigger opening in the grip more difficult.

Figure 9:
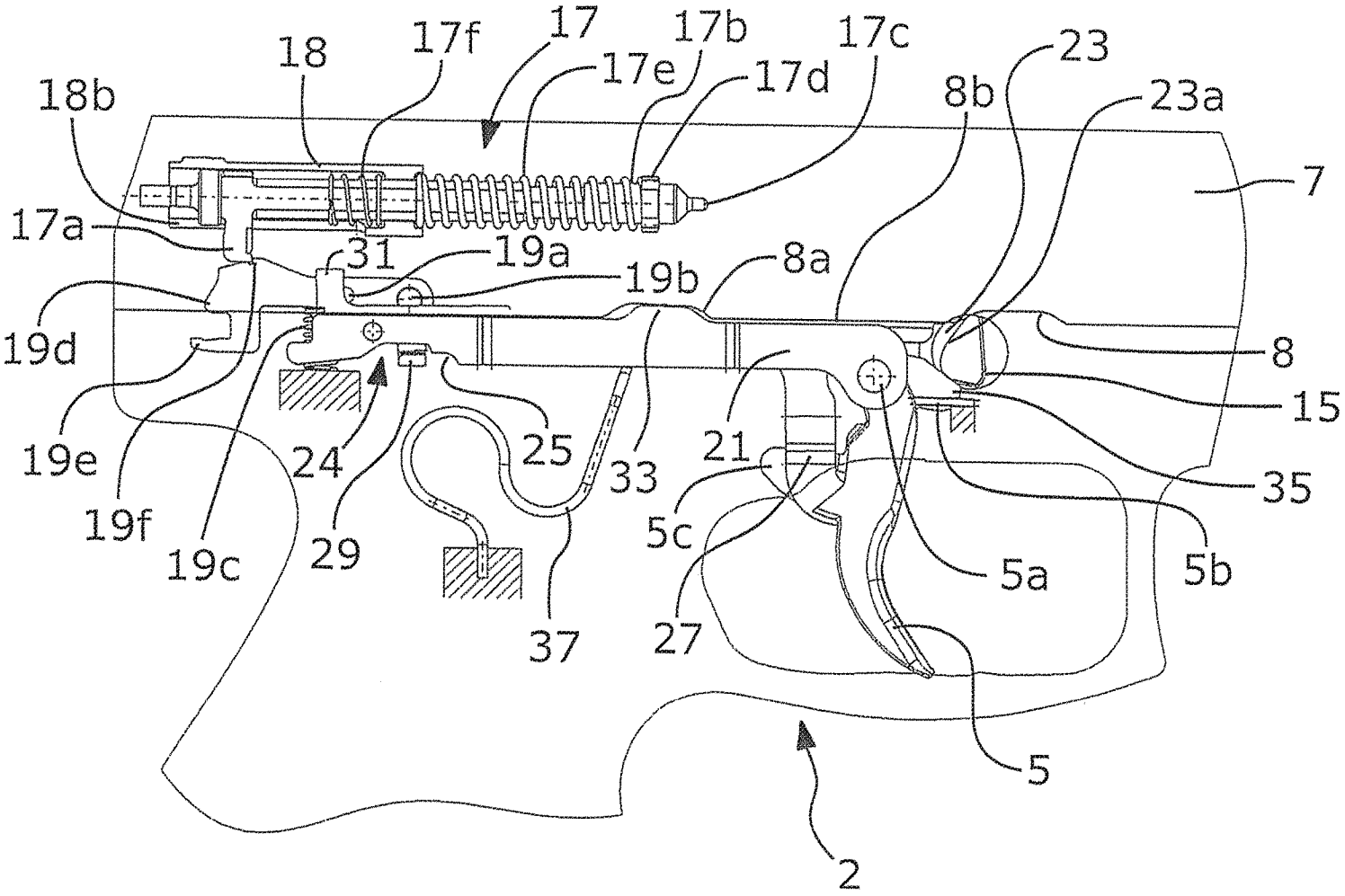
FIG. 9 shows a part of the trigger mechanism of the self-loading pistol according to FIGS. 1 through 8 in a lateral view with a section of the lock slide.
Figure 12:
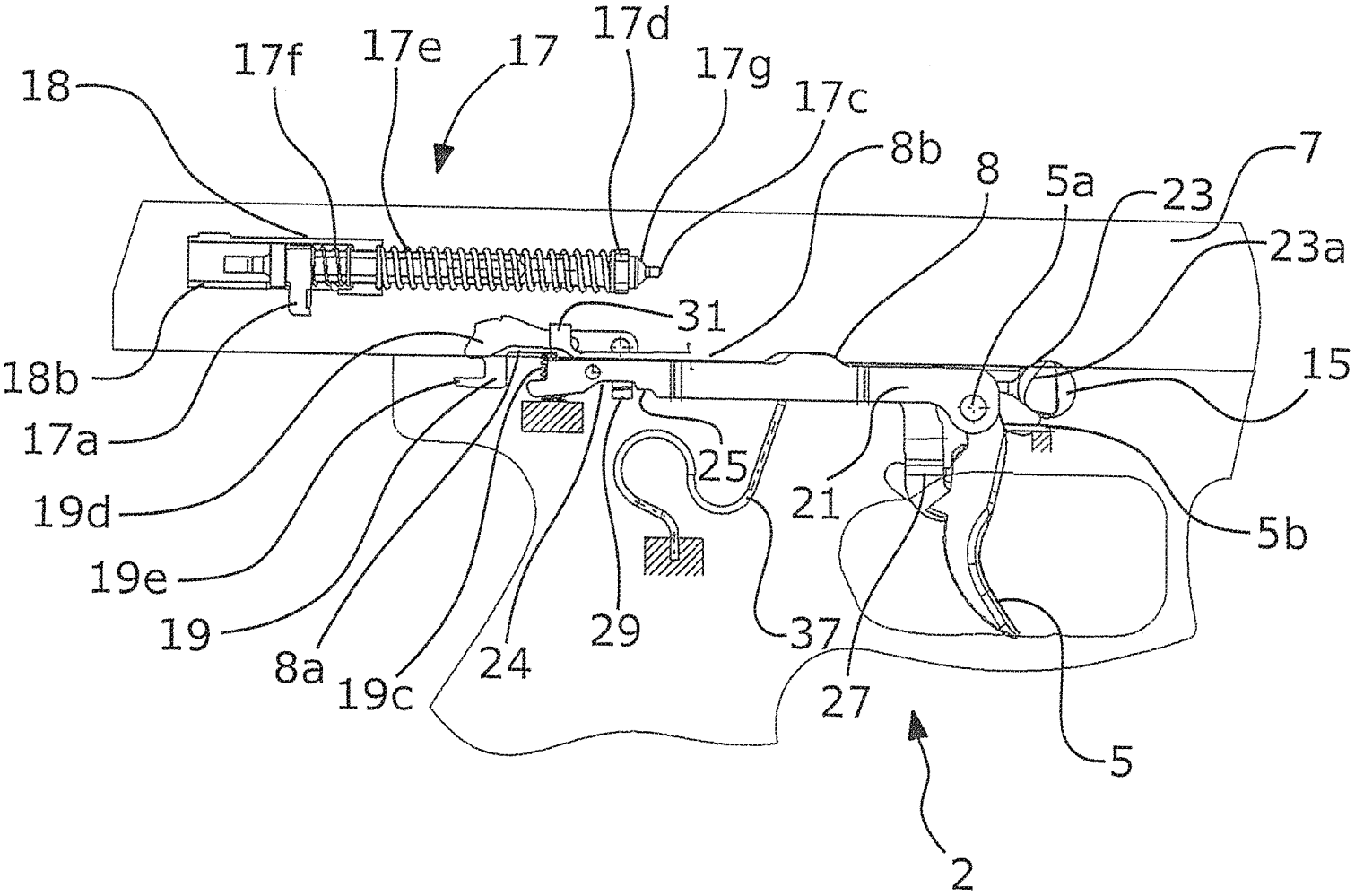
FIG. 12 shows a lateral view of the part of the trigger mechanism from FIG. 9, however with a retracted lock slide caught by the slide catch.
Figure 14:
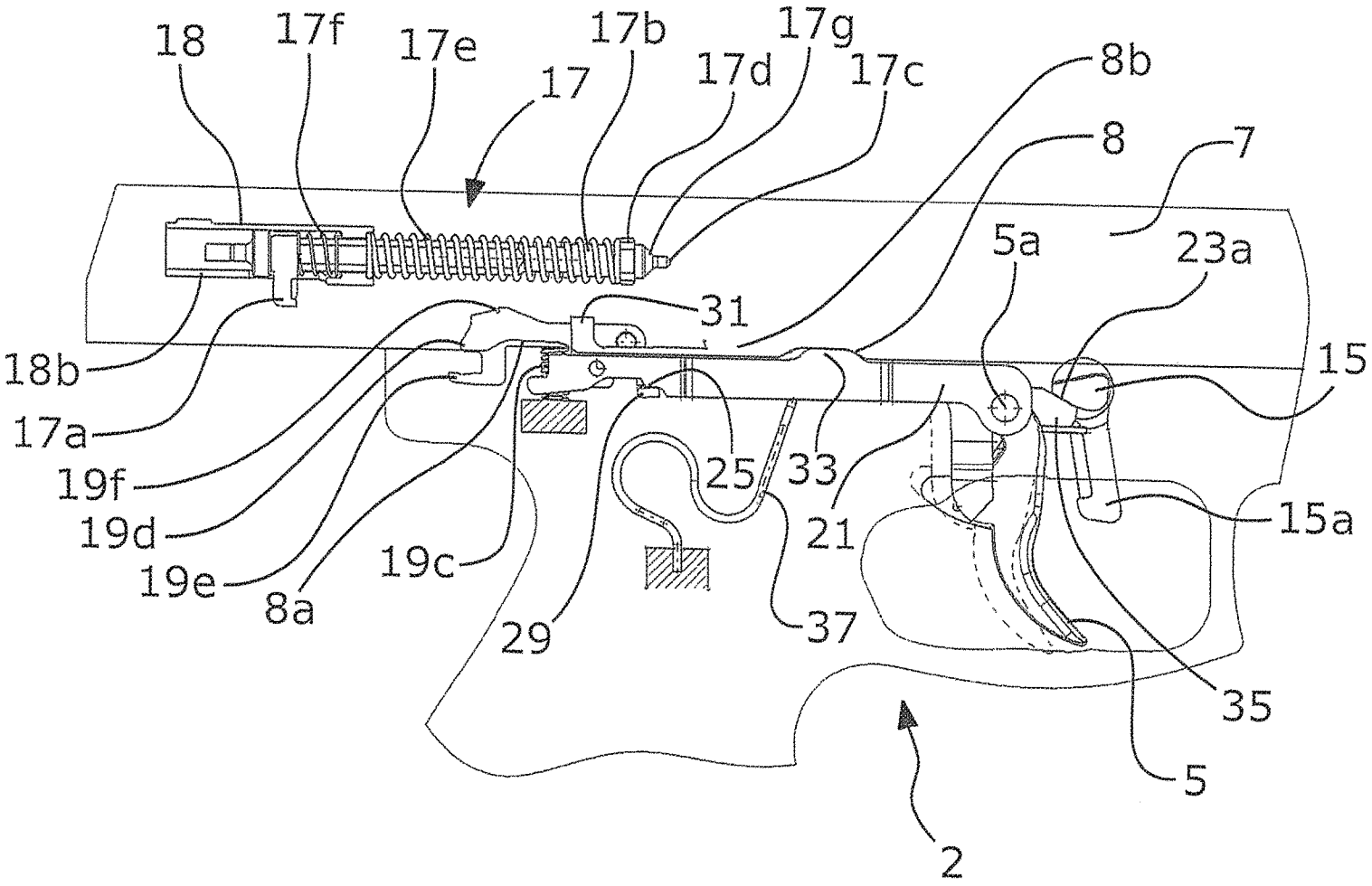
FIG. 14 shows a lateral view of the trigger mechanism from FIG. 12, however with a rotated disarming shaft in disarming position and above the trigger spring and the springs 37 with trigger moved forward and trigger bar.

The trigger bar 27 is coupled in terms of movement with its front end via a pin 5*d* acting as a trigger bar bearing axis forcing the trigger 5 through transversely to the direction of fire and pivoted around the pin 5*d*. The trigger bar 27 is coupled in known manner for its support in the grip 2 on its underside approximately centrally with a double curved (earthworm-like curves) spring 37 (cf. FIGS. 6 and 7). The trigger bar support in the grip 2 is schematically shown in FIGS. 9, 12 and 14. This spring facilitates a vertical and translational movement of the trigger bar 27 as well as a movement of the trigger 5 to its resting position. On its rear end the trigger bar 27 comprises a lower tab 29 formed on the right and on its upper end an upper tab 31 formed on the left. The functions of the tabs 29 and 31 will be explained later.

The trigger also comprises a safety latch 5*e*, which in known manner protects the trigger from an unintentional release of said trigger in the case of gravitational or shock accelerations. This security latch 5*e* is likewise pivoted in the trigger on the trigger bar bearing axis 5*d* and in the case of the actuation of the trigger is automatically swiveled around this axis and against a spring in the trigger not shown in the figure, as a result of which the trigger is unlocked vis-à-vis the grip and which can be pivoted around the trigger shaft (5*a*).

Figure 6:
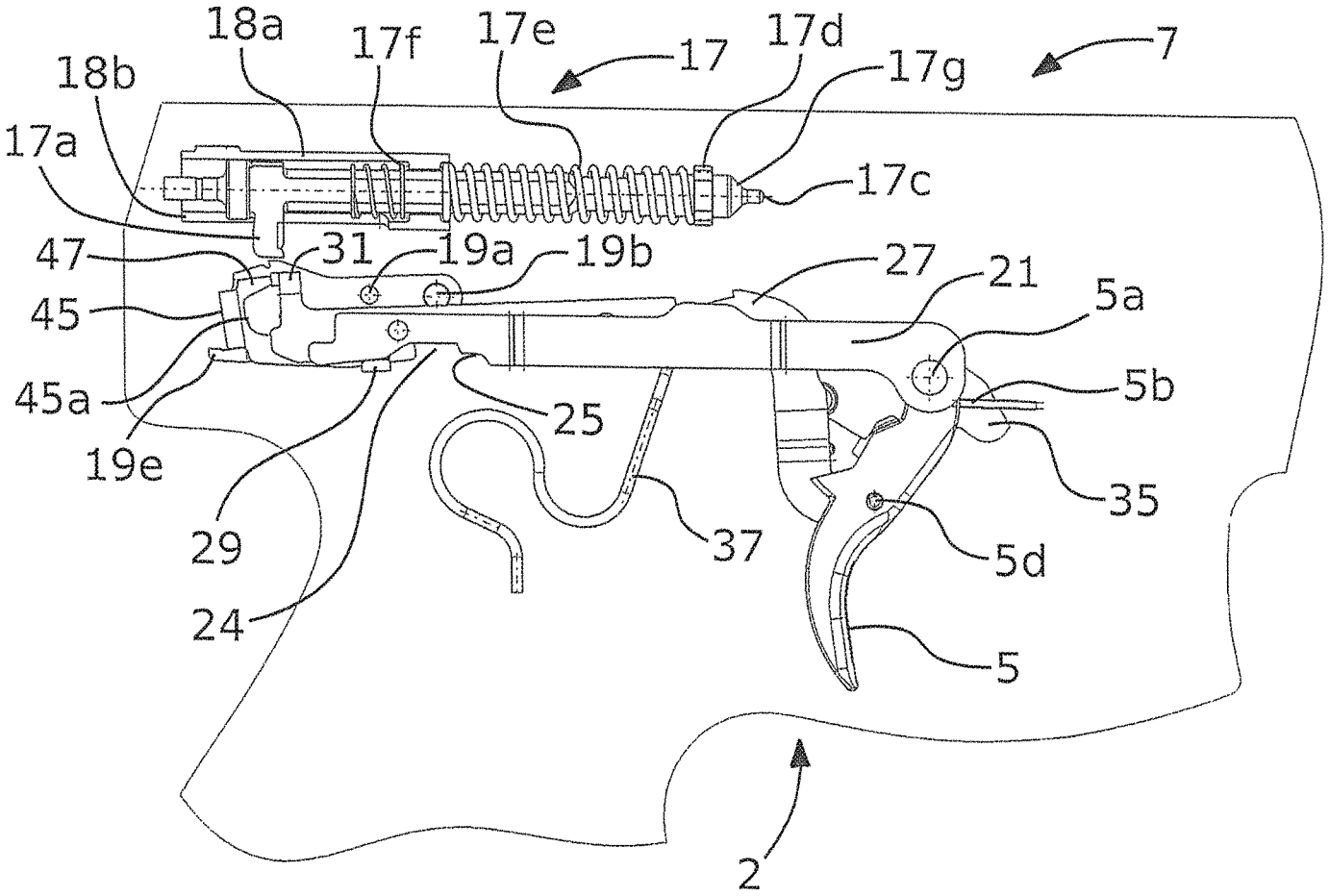
FIG. 6 shows a part of the trigger mechanism of the self-loading pistol according to FIG. 5 with a pressed trigger, in the case of the release of the firing pin in a lateral view.
Figure 7:
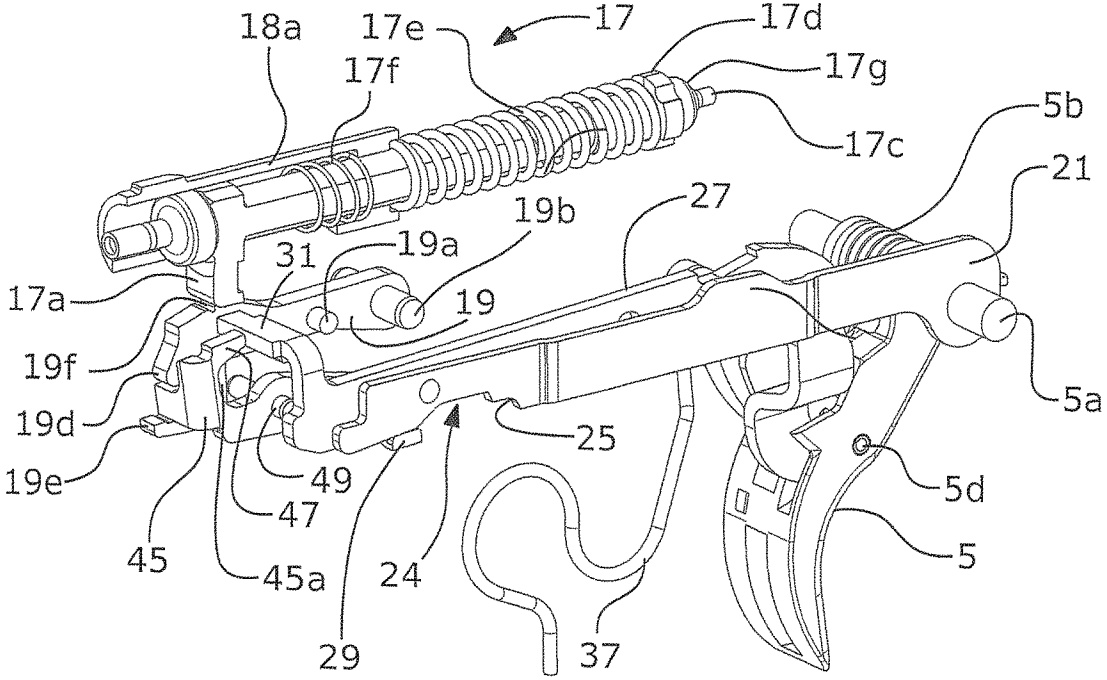
FIG. 7 shows a part of the trigger mechanism of the self-loading pistol according to FIG. 5 with a pressed trigger, in the case of the release of the firing pin seen at an angle from above, rear.

The release pawl 45 shown in FIGS. 6 and 7 is provided on the left side, on the rear end of the trigger bar 27. The release pawl 45 is pivoted around a release pawl bearing axis 49 deployed in the grip 2 forcing it through transversely to the direction of fire. The deployment of the release pawl bearing axis 49 in additional wall elements of the grip 2 is known and not shown in the figure. The release pawl 45 is bent to the left on its rear, lower end tab-shaped for engagement with the sear 19 (cf. following paragraph) and comprises on its rear upper end a nose 47 projecting in the direction of fire to the upper tab 31 of the trigger bar 27.

The sear 19 is provided in the region of the rear end of the trigger bar 27 and parallel to it, on the left side of the upper nose 37 of the release pawl 45 underneath the firing pin 17 and is pivoted around a bearing axis 19*b* in the grip 2. On the rear end of the sear 19 a nose 19*d* protrudes centrally to the rear. Underneath the nose 19*d* a somewhat rectangular recess connects, which is limited on the bottom by a hook-like end 19*e* of the sear 19 (cf. FIG. 15). The release pawl 45 engages into this recess with its lower tab-like end (cf. FIGS. 6 and 7). A compression spring (cf. FIGS. 8 through 17) provided centrally on the underside of the sear 19, acting as a return spring 19*c*, supports the sear 19 downward in the grip 2. The support in the grip 2 is shown schematically in FIGS. 9, 12 and 14. On the front end of the sear 19 a pin 19*a* extending in the direction of the trigger bar 27 transversely to the axis of the bore of the pistol 1 is provided. On the topside of the sear 19 a step 19*f* is attached.

The firing pin 17 is pivoted in longitudinally displaceable manner in a firing pin guide 18 and comprises on its front end a firing pin tip 17*c*. From its firing pin tip 17*c* it thickens conically to the rear to an annular shoulder 17*d* serving as a firing pin spring bearing, to which in turn a section 17*b* with low diameter connects. A firing pin spring 17*e* surrounds the firing pin 17, said spring supporting itself with its front end on the shoulder 17*d* and with its rear end on a firing pin guide sleeve 18*a* provided in the firing pin guide 18 and surrounding the firing pin 17. The firing pin guide sleeve 18*a* guides the rear end of the firing pin 17. The firing pin guide sleeve 18*a* has a longitudinal slot 18*b* on its underside running about ⅘ of the length of the sleeve, in which the lug 17*a* of the firing pin is guided.

On its rear end the firing pin guide 18 is supported on the termination and support piece 58, in whose inner contour it is immersed spring-loaded and thus locks the termination and support piece 58 that is vertically displaceable to the direction of fire in the rear part of the lock slide and pivoted in a link in known manner as in the case of other pistols.

Further, on the rear end of the firing pin 17 a lug 17*a* protruding downward, forcing through the firing pin guide sleeve 18*a* in the longitudinal slot 18*b* is provided. Within the firing pin guide sleeve 18*a* a firing pin return spring 17*f* is arranged: This firing pin return spring is supported with its rear end on the firing pin lug 17 and with its front end on the firing pin guide sleeve 18*a* and in the case of a fired firing pin 17 in resting position pulls it back to the rear.

As initially described, the sear 19 protrudes in its cocking position with its rear upper end in the path of motion of the lug 17*a* and in the cocking and rotating of the cylinder of the pistol 1 catches the firing pin 17 proceeding with the lock slide 7 on its lug 17*a*. In the cocking position shown in FIG. 5 the lug 17*a* adjoins with its lower front edge in the step 19*f* of the sear 19 and is held by it. The further advanced lock slide 7 has tensioned the firing pin spring 17*e* in known manner against the firing pin spring bearing 17*d*, since the lock slide 7 carries the firing pin guide sleeve 18*a* along during the further advancement, so that its front end compresses the firing pin spring 17. The trigger mechanism is ready to fire in this mutually operative connection.

FIGS. 6 and 7 show the tensioned firing pin 17 at the moment of its release through the sear 19. The trigger 5 is actuated to the rear against the spring force of the torsion spring 5*b* and of the spring 37. The pin 5*d* has carried the trigger bar 27, which is coupled on it, along to the rear, wherein the front end of the trigger bar has moved along a circular path around the trigger shaft to the rear, above. The rear end of the trigger bar 27 is displaced in longitudinal direction to the rear, below in comparison to FIG. 5, wherein the lower tab 29 of the trigger bar 27 is guided from a recess 24 in a disconnector bar 21 to the rear and thus moves the rear end of the trigger bar 27 downward. The upper tab 31 of the trigger bar 27 in the process impacts with its rear face the nose 47 of the release pawl 45, so that said pawl is pivoted along a circular path around its bearing axis 49 to the lower rear. In the process the release pawl 45, via its engagement has swiveled the sear 19 against the spring force of the return spring 19*c* (cf. Figure. 9 and the following) around the bearing axis 49 to the lower rear. The lug 17*a* as result disengages from the step 19*f* of the sear 19 and can freely move forward for firing. At the end of its path of motion the firing pin 17 strikes with its tip 17*c* on a cartridge bottom of a cartridge provided in the cartridge chamber 51 not shown in the figure and ignites in known manner a propellant charge.

Figure 8:
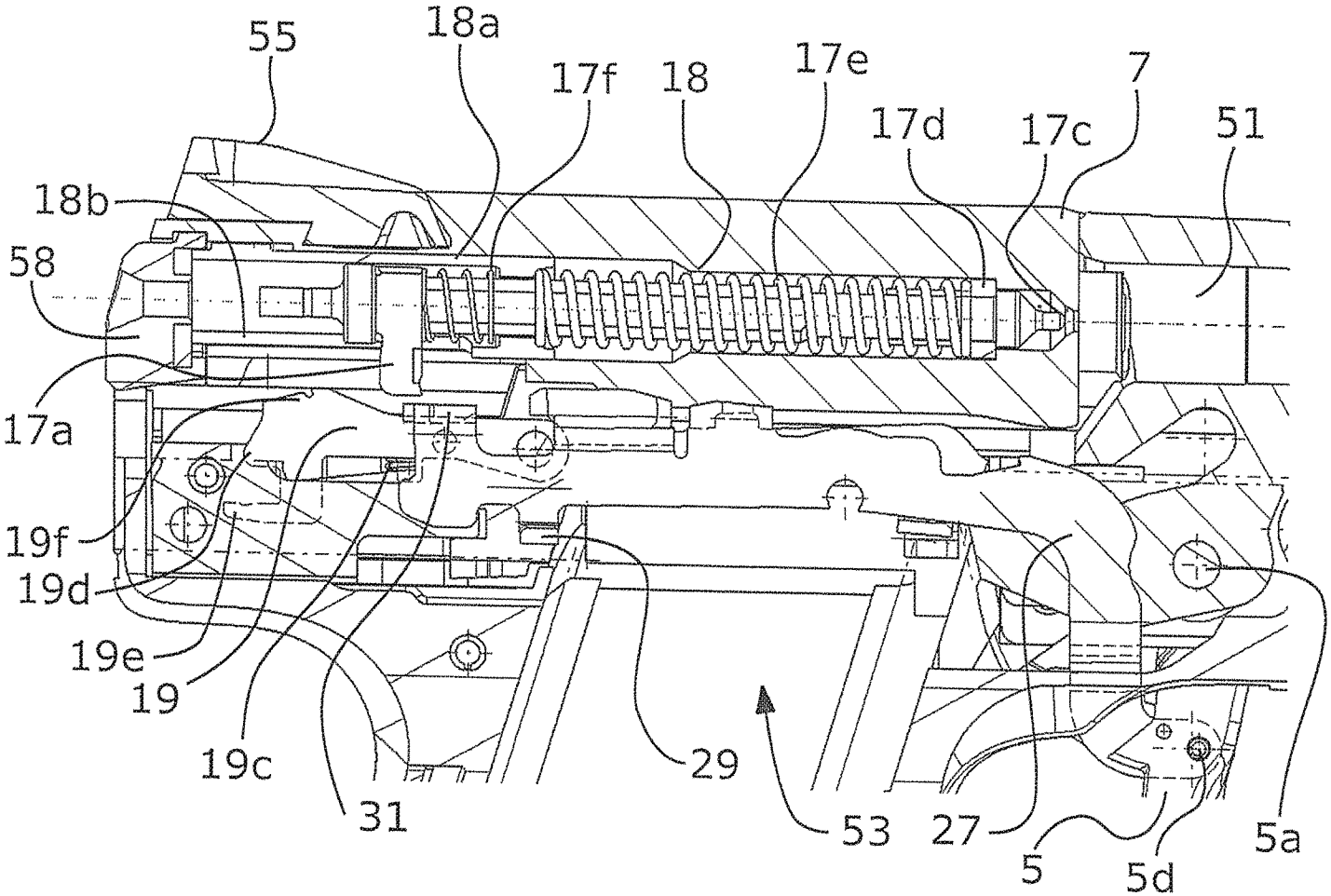
FIG. 8 shows the self-loading pistol according to FIG. 5 with uncocked firing pin spring and uncocked trigger, after dry firing of the firing pin in partial sectional view.

FIG. 8 shows the pistol 1 with a released firing pin and empty cartridge chamber. The firing pin spring 17*e* is uncocked and the firing pin 17 is in its front position, at a distance from the cartridge chamber 51. Since the firing pin spring 17*e* is supported on the shoulder 17*d*, it does not push the firing pin 17 completely and permanently to a primer of the cartridge in the cartridge chamber that is not shown in the figure. Instead, when the round is fired the firing pin 17, due to its inertia, goes beyond the position shown in FIG. 8 and in the process compresses its return spring 17*f* in the firing pin guide sleeve 18*a*. After advancement and in the event of an empty cartridge chamber 51 the return spring 17*f* retracts the firing pin 17 slightly, until the firing pin head 17*g* abuts the firing pin spring bearing (17*d*).

The trigger 5 is swiveled back to its resting position in FIG. 8. The pin 5*d* in the process has carried the trigger bar 27 coupled to it forward, wherein the front end of the trigger bar has moved on its circular path around the trigger shaft 5*a* forward, below. The rear end of the trigger bar 27 is back in its initial position according to FIG. 5, as are the sear 19 and the release pawl 45 not shown in FIG. 8.

To cock the firing pin 17 and its spring 17*e* the lock slide 7 must be pulled back until the sear 19 leaves the lug 17*a*. After that the lock slide should be released again.

The structure and function of the device for prevention of the tensioning of a firing pin spring in the disarming of a self-loading pistol 1 will now be described with the assistance of FIGS. 9 through 17. Since the firing pin spring 17*e* is not tensioned in the disarming, it is also not possible for an unintentional shot to be fired.

The device for prevention of the tensioning of a firing pin spring comprises according to FIGS. 9 through 17 the following components: the trigger 5, the disarming shaft 15, the trigger bar 27 coupled with the trigger 5, the disconnector bar 21, the sear 19, the firing pin 17 with its lug 17*a* and the lock slide 7. The interaction of these components in the disarming will be described below.

Figure 10:
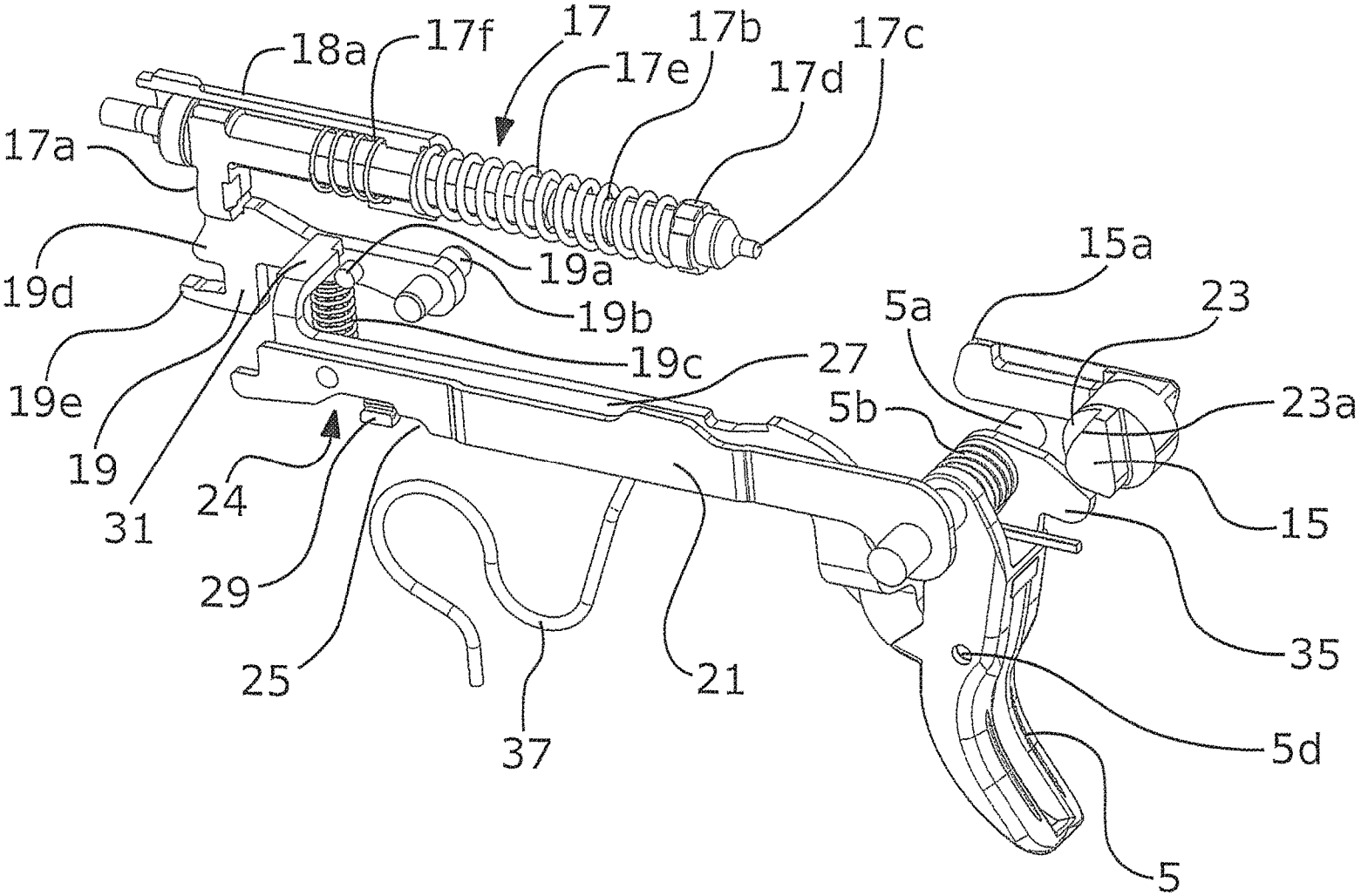
FIG. 10 shows a perspective view of part of the trigger mechanism according to FIG. 9 at an angle from above, however without the lock slide.
Figure 11:
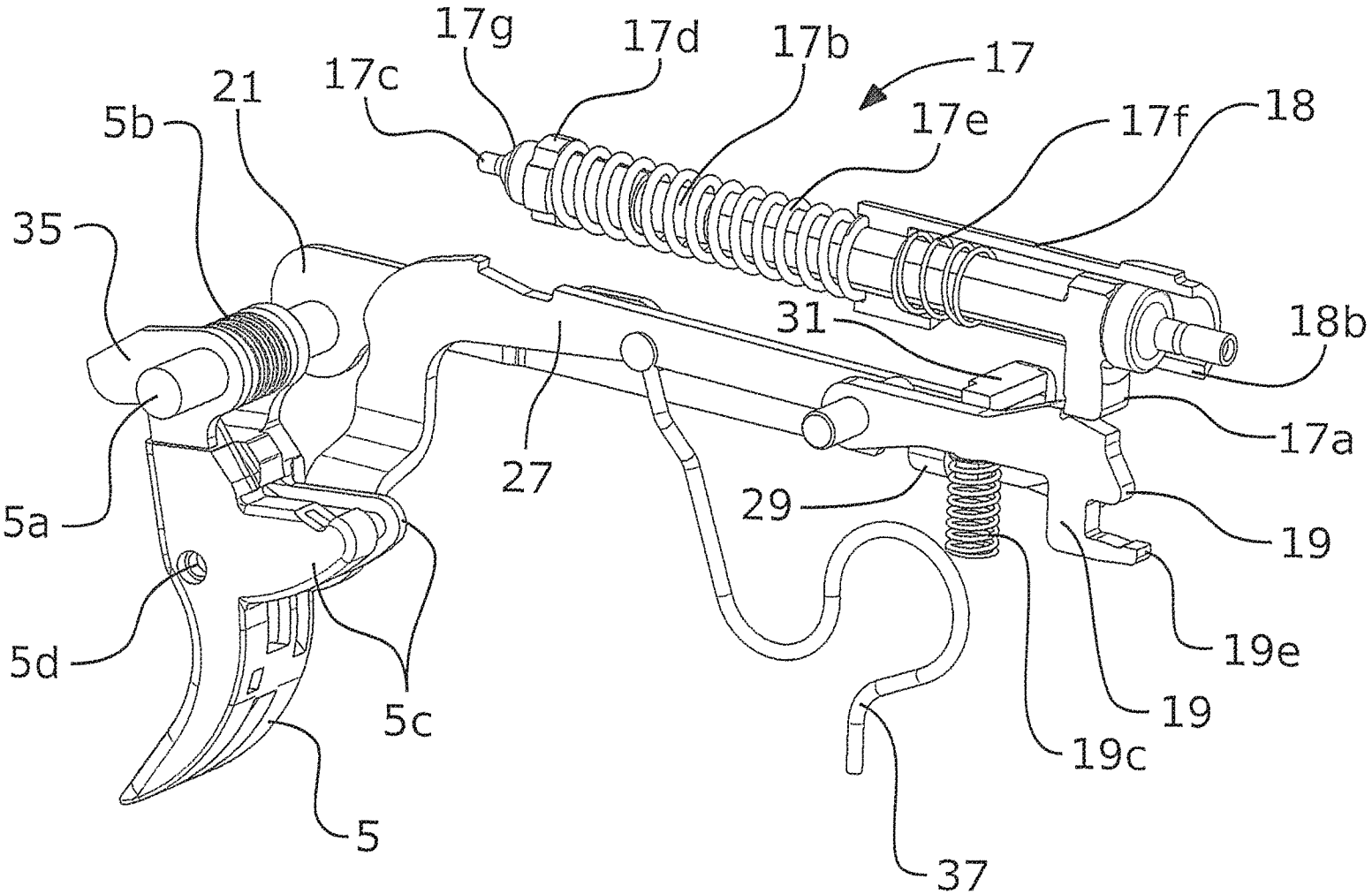
FIG. 11 shows a representation analogous to FIG. 10 from the left side at viewed at an angle from above, rear.

FIGS. 9 through 11 show a part of the trigger mechanism in its cocking position in the case of a closed lock slide 7 as well as the firing pin 17 in its cocking position. The lock slide 7 shown in FIG. 9 (schematic) is in its front position, in which its front end is nearly flush with the barrel 9 (cf. also FIG. 1). The handle 15*a* of the disarming shaft 15 points horizontally to the rear in its locking position (cf. also FIG. 10) and prevents, as initially described, a disarming of the pistol 1.

The trigger 5 comprises on its upper end a stop 35 configured as a lug protruding forward, which is spring loaded by the torsion spring 5*b* and the spring 37 pre-stressing the trigger in its resting position abuts the inner circumference of the disarming shaft 15.

The disarming shaft 15 prevents a translational forward motion of the stop 35 here and thus a forward motion of the trigger 5 and the trigger bar 27 coupled with the trigger. FIGS. 10 and 11 show this state in each case viewed from an angle above from the right or left side of the pistol 1—however without representation of the lock slide 7. On the rear side of the inside part of the disarming shaft 15 a recess 23, preferably wedge-shaped, is provided, which faces the stop 35 only in the disarming position, that is, only when the disarming shaft 15 is rotated in this position, and thus makes space for a forward motion of the stop 35 (cf. FIGS. 10 through 13).

The disconnector bar 21 is pivoted around the trigger shaft 5*a* on its front end and comprises on its rear end an approximately half-round, tub-shaped recess 24, which has in its front region a step 25 rising from the tub bottom. On the upper side of the disconnector bar 21 facing the lock slide 7 a roughly trapezoid elevation 33 is constructed. This is provided in the lock slide 7 for engagement with a complementary first, front recess 8 or with a second, rear recess 8*a*. In the closed lock slide position shown here the elevation 33 is in engagement with the rear recess 8*a*. When the lock slide 7 is moved to the rear it glides with its non-recessed region 8*b* over the elevation 33, impacts it downward and as a result swivels the disconnector bar 21 downward, until the elevation 33 reaches the slide catch position in engagement with the front recess 8 (cf. FIG. 12).

In the uncocked position shown in FIGS. 9 through 13 the trigger bar 27 grips from below with its lower tab 29 roughly centrally the recess 24 of the disconnector bar 21 and is spaced apart from the step 25. The upper tab 31 protrudes laterally in the direction of the sear 19 arranged in the rear next to the trigger bar 27. The trunnion 19*a* of the sear 19 is offset somewhat to the front of the tab 31, so that these two elements do not engage one another in the cocking position of the trigger bar.

In FIG. 12 the lock slide 7 is retracted to its slide catch position. Proceeding from FIG. 9 in the retracting of the lock slide 7 the roughly trapezoid rear slide recess 8*a* glides across its front angled deflector—under the influence of the force directed at an angle behind—over the elevation 33 of the disconnector bar 21. The non-recessed region 8*b* of the lock slide 7 then downwardly impacts the disconnector bar 21 in the retraction of the lock slide 7 until the elevation 33 engages with the front slide recess 8. The rear recess 8*a*, which in FIG. 9 was still in engagement with the elevation 33 of the disconnector bar 21, is free. The lock slide 7 carries the firing pin 17 arranged within along with it to the rear during the retraction, so that its lug 17*a* disengages with the sear 19. The firing pin spring 17 is uncocked in this state.

If the trigger bar 27 releases the sear 19 as shown in FIGS. 6 and 7, and the firing pin 17 ignites a cartridge located in the cartridge chamber, then during the return of the slide 7 over the non-recessed region 8*b* of the slide the disconnector bar 21 is moved downward over its elevation 33 and carries along the trigger bar via the lower latch (29) of the trigger bar 27 abutting the disconnector bar 21.

As a result of this, the upper tab 31 of the trigger bar 27 slides downward to the recess 45*a* of the release pawl 45, whereupon the release pawl 45 and the sear 19 are returned to their initial and catch position by the return spring 19*c* and the firing pin can be caught again during the forward motion of the lock. If the trigger is released again after firing, the lower tab 29 of the trigger bar 27 slides back to the recess 24 of the disconnector bar 21. In the process, the spring 37 presses the trigger bar 27 upward to its initial position (cf. FIG. 5), as a result of which the upper bar 31 of the trigger bar comes to rest against the nose 47 of the release pawl 45 again and the cocked firing pin 17 can be released again by actuation of the trigger via the upper tab 31 of the trigger bar 27 and the nose of the release pawl 45. The disconnector bar 21, as indicated by its name, also serves as a disconnector element in the case of semi-automatic locking.

Figure 13:
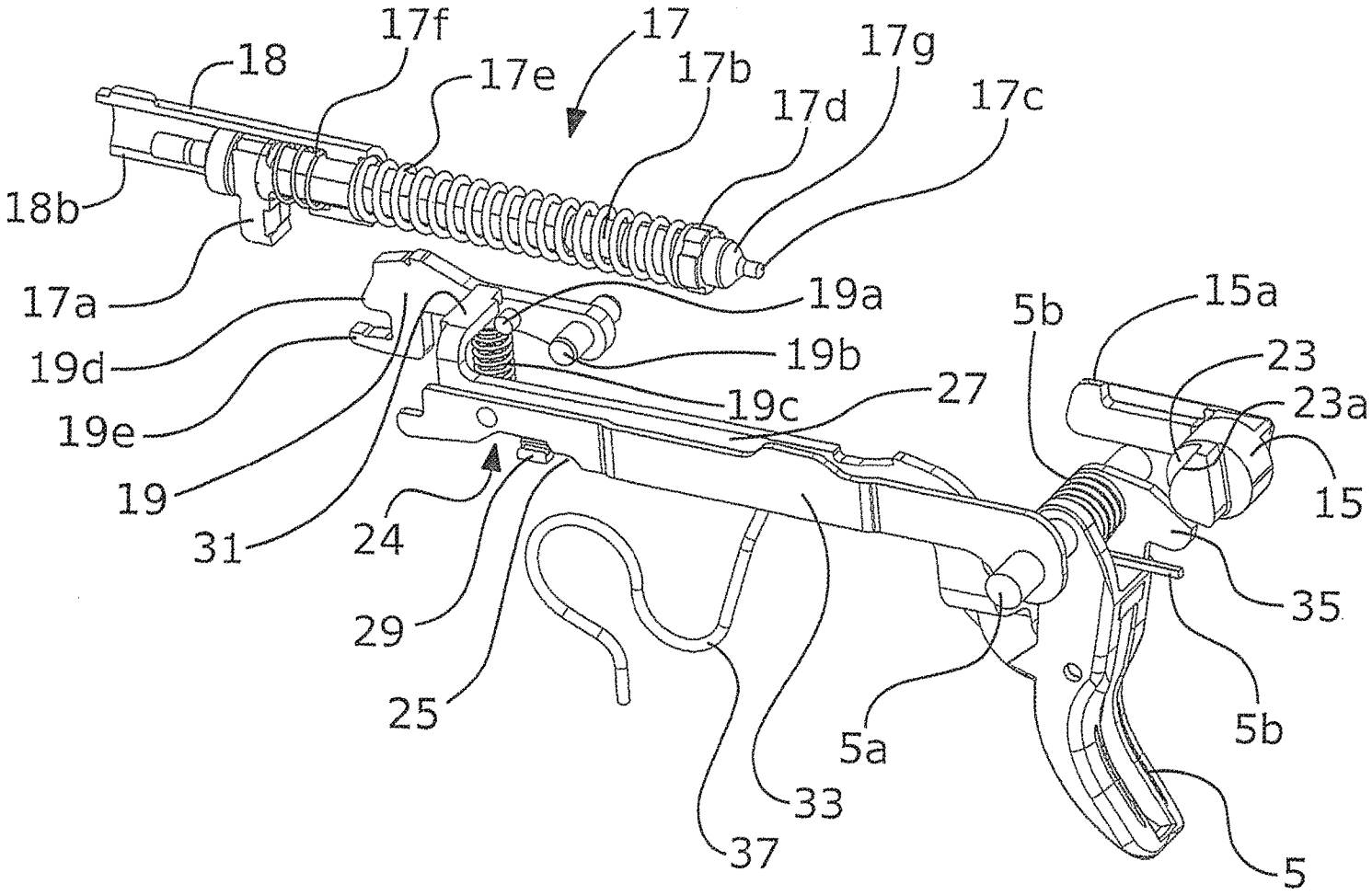
FIG. 13 shows a perspective view of the trigger mechanism from FIG. 12 at an angle from above, however without the lock slide.

In FIG. 12 the disarming shaft 15 is still in its locking position, so that the stop 35 of the trigger 5 continues to abut the disarming shaft 15 during pre-stressing of the trigger torsion spring 5*b* and the spring 37. FIG. 13 shows this state in a view at an angle from above.

Figure 15:
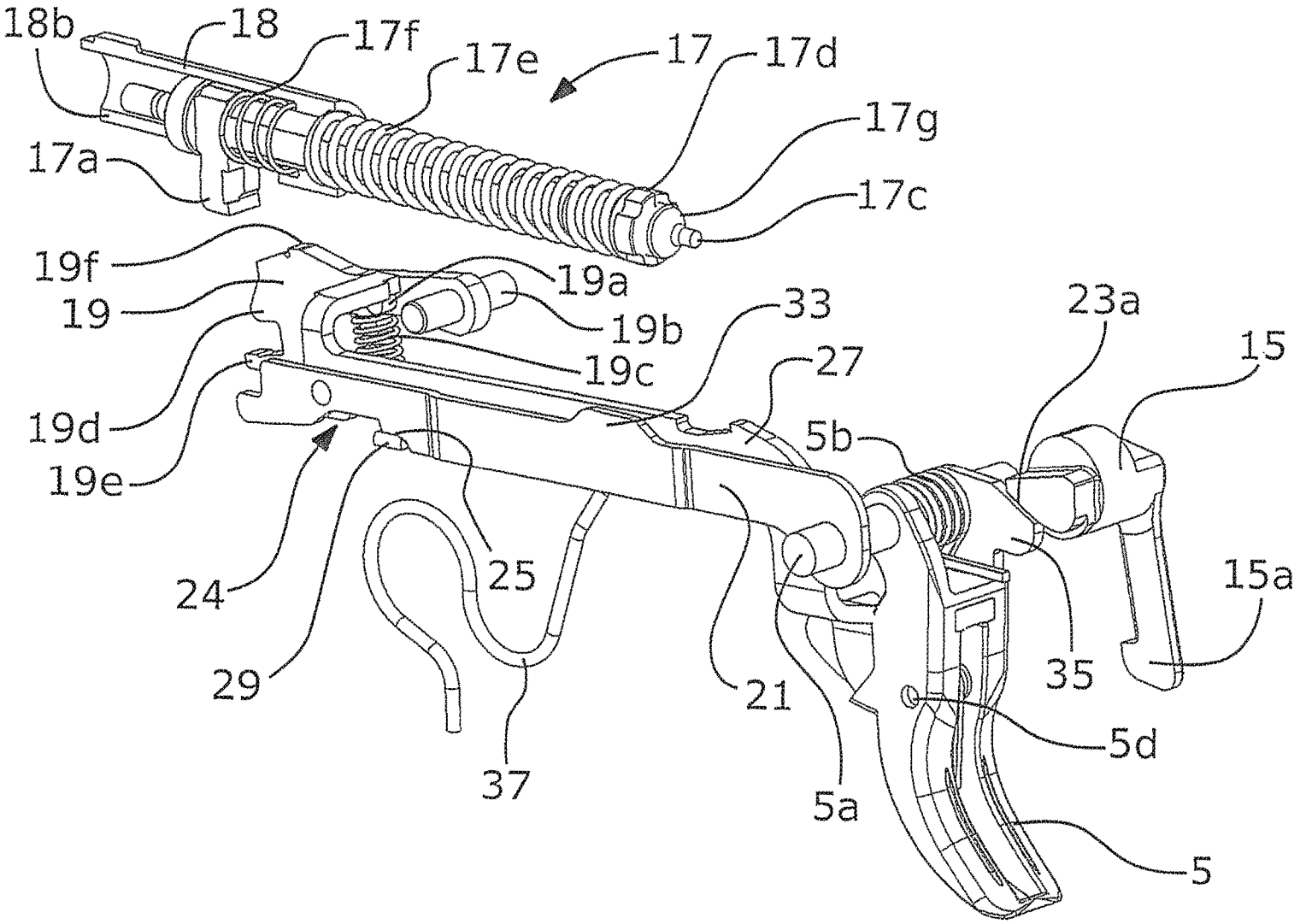
FIG. 15 shows a perspective view of the trigger mechanism from FIG. 14 at an angle from above.

FIGS. 14 and 15 show the disarming position of the device for prevention of the tensioning of a firing pin spring in the disarming. In contrast to FIGS. 12 and 13, the outer handle 15*a* and thus the disarming shaft 15 is rotated downward in a clockwise direction by approximately 90°. After the rotation the recess 23 with its edge 23 of the disarming shaft 15 faces the spring-loaded stop 35. Said stop swivels with the trigger 5 under the force effects of the trigger torsion spring 5*b* and the spring 37 in counter-clockwise direction on a circular path around the trigger shaft 5*a* until it impacts the upper edge 23*a* of the recess 23. The initial position of the trigger 5 is shown dashed in FIG. 14. In the case of its swivel motion the trigger 5 also carries along the trigger bar 27 coupled with it forward to the position shown in FIGS. 14 and 15. As a consequence, the lower tab 29 of the trigger bar 27 comes to rest below the step 25 of the disconnector bar 21 and the upper tab 31 of the trigger bar 27 comes to rest above the trunnion 19*a* of the sear 19. The lock slide is still in its rear slide catch position.

Figure 16:
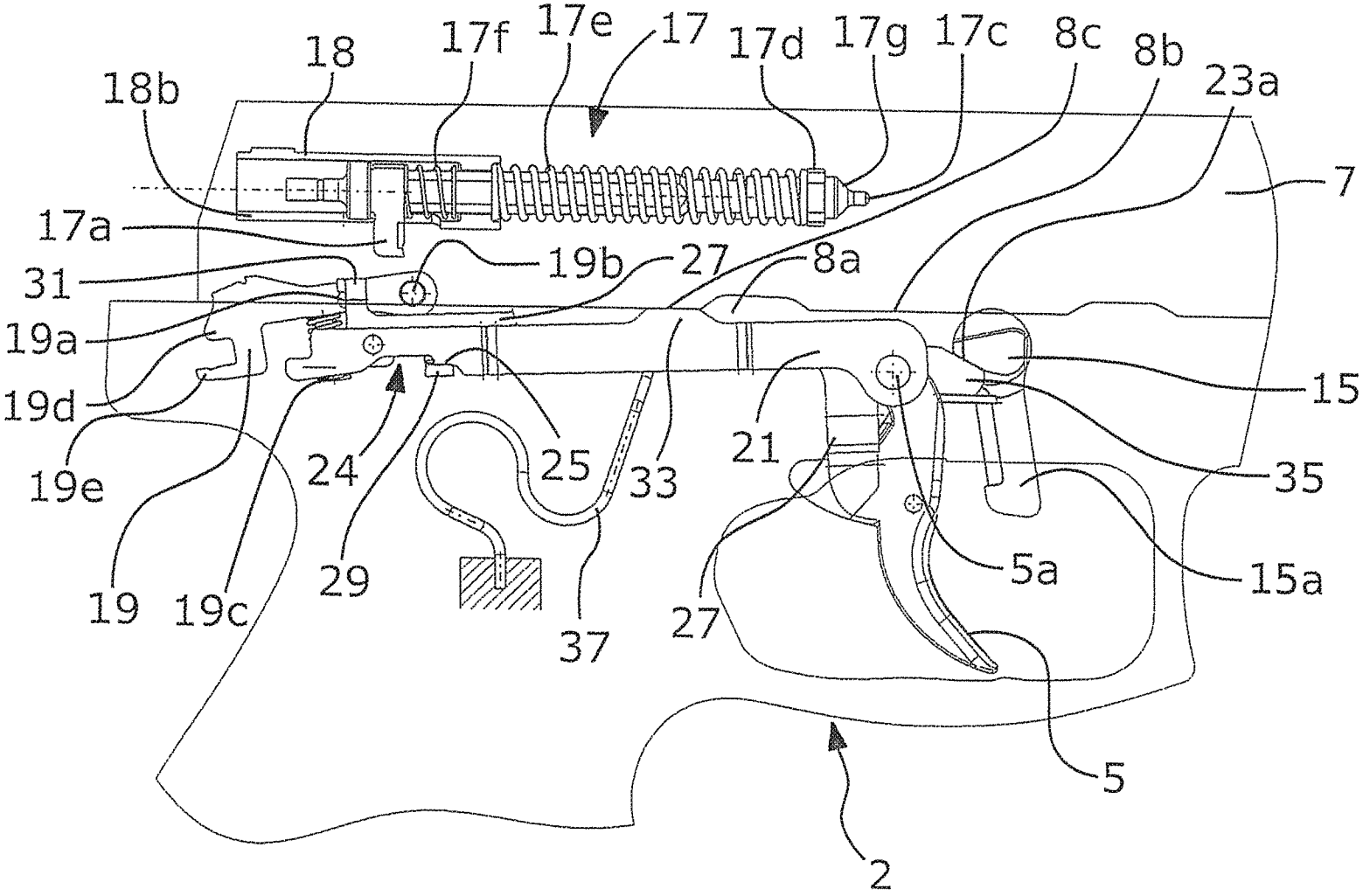
FIG. 16 shows a lateral view of the trigger mechanism from FIG. 14, however with a lock slide partially guided forward.
Figure 17:
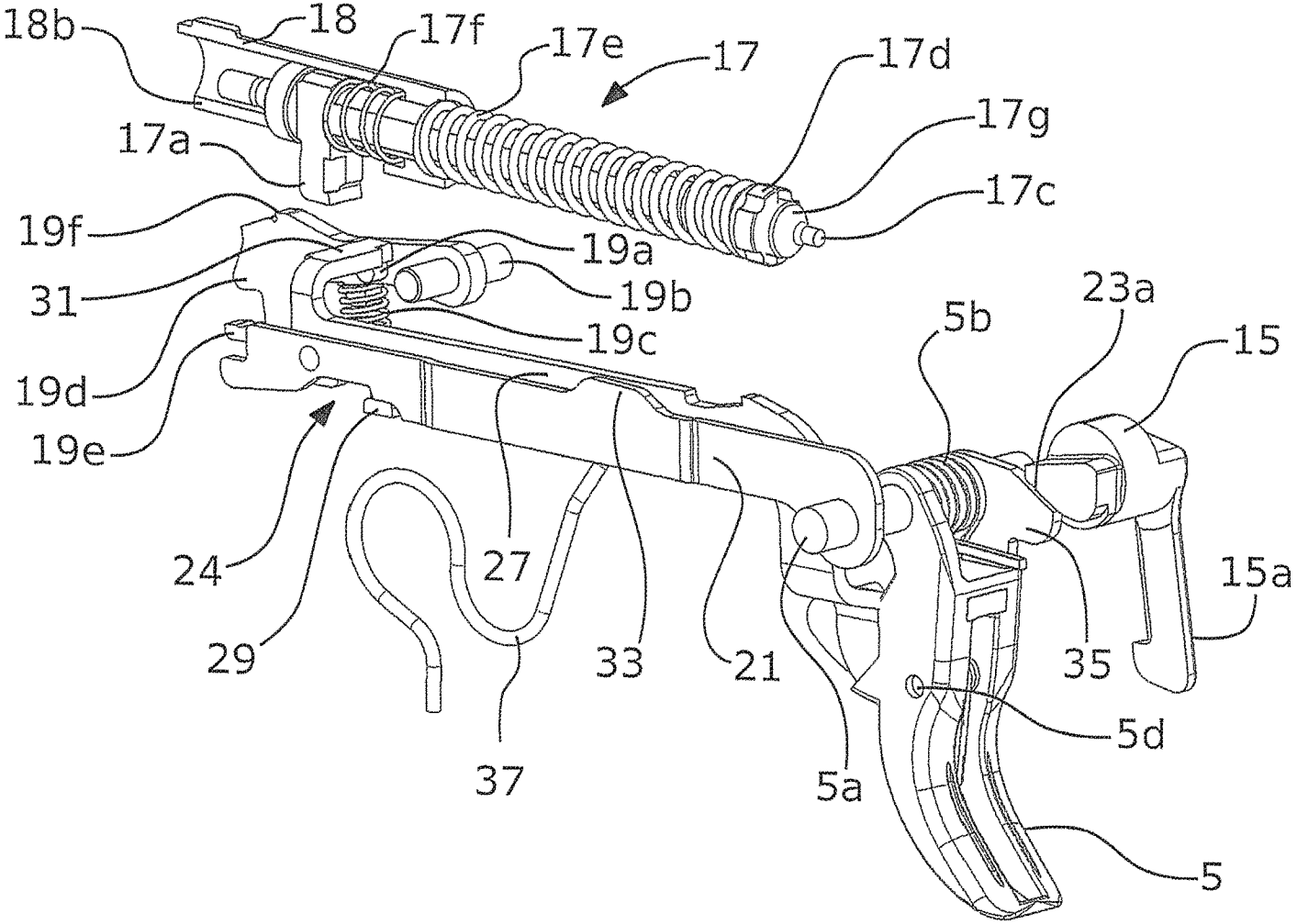
FIG. 17 shows a perspective view of the trigger mechanism from FIG. 16 at an angle from above, however without the lock slide.

FIGS. 16 and 17 still show the device for prevention of the tensioning of a firing pin spring during disarming in its disarming position as well as the lock slide 7 guided by the user for disarming of the self-loading pistol partially forward. Proceeding from FIG. 14, in the forward motion of the lock slide 7 the trapezoid front recess 8 glides across its left rear angled deflector under the influence of the force directed forward across the elevation 33 of the disconnector bar 21. The lower contour of the non-recessed region 8*b* of the lock slide 7 downwardly impacts the elevation 33 and with it the disconnector bar 21 during the further forward motion of the lock slide 7. Since the trigger bar 27 abuts with its lower tab 29 on the step 25 of the disconnector bar 21, the trigger bar is likewise moved downward via the disconnector bar 21 and in the process, in the event of the forward motion of the lock in unlocked position of the disarming shaft 15 with its upper tab 31 disengages the sear 13 via its trunnion 19*a* with the likewise forward gliding lug 17*a* of the firing pin, so that the firing pin is neither caught nor cocked. In the closed position of the lock slide 7 the elevation 33 is in the rear recess 8*a* and is not impacted. In the pulling of the lock slide 7 forward the non-recessed region 8*c* of the elevation impacts the elevation 33. During its impact by the non-recessed region 8*b* or 8*c* the disconnector bar 21 in the disarming position positively forces its step 25 on the tab 29 and thus the trigger bar 27 downward. Said trigger bar with its upper tab 31 in the process is brought into form-fitting engagement with the trunnion 19*a* of the sear 19 and moves it, as has already happened in the case of the recess 8 and the non-recessed region 8*b*, against the force of the return spring 19*c* downward out of the circular path of the lug 17*a* on the firing pin 17, wherein the lug 17*a* on the firing pin 17 in this position of the lock slide 7 can no longer be caught by the sear 19. In the locking position, on the contrary the disarming shaft 15 blocks the trigger bar 27 in its rear position, so that in the case of a non-actuated trigger its lower tab 29 is offset laterally to the step 25 approximately centrally in the recess 24 of the disconnector bar 21 (cf. FIGS. 9 through 13). In this position the disconnector bar 21 cannot impact the tab 29, since the depth of the recess 24 corresponds approximately to the height of the elevation 33 so that a positive connection of these elements is not possible. Also, in the cocking position the top tab 31 of the trigger bar 27 is offset in longitudinal direction to the trunnion 19*a* (cf. FIGS. 9 through 13) and therefore cannot impact it.

In the disarming position of the individual elements shown in FIGS. 16 and 17 a risk-free pulling of the lock slide 7 forward is possible, since the sear 19 can no longer catch the firing pin 17 on its lug 17*a* and therefore also cannot tension the firing pin spring 17*e*.

In principle it is possible to replace the recesses 8, 8*a* of the lock slide 7 and the elevation 33 of the disconnector bar 21 with other geometrical shapes and as a result likewise enable an effective transfer of force. The step 25 of the disconnector bar 21 and the trunnion on the sear 19 or the tabs 29, 31 on the trigger bar 27 can likewise be replaced by other functionally comparable elements without restricting the efficiency of the device.

I claim:

1. A device for prevention of the tensioning of a firing pin spring in the disarming of a hammerless self-loading pistol provided with a lock slide, wherein the device can assume a disarming position and a locking position, the device comprising:

a spring-loadable firing pin with a lug formed thereon for active engagement with a sear, wherein in the locking position for cocking the firing pin spring the sear protrudes into the path of motion of the lug and in the disarming position the sear is disengaged from the lug, a trigger bar coupled with a trigger which, in the disarming position, disengages the sear from the lug, a disarming shaft, which in the disarming position enables movement of the trigger and thus the trigger bar to the front, and a disconnector bar that can be coupled to the trigger bar, said disconnector bar being impacted in the disarming position by the lock slide moved to the front to operatively disengage the sear from the lug by the trigger bar.

2. The device according to claim 1, in which a stop is provided on the trigger and wherein the disarming shaft has a section with reduced diameter that at least partially receives the stop in the disarming position in the event of a rotated disarming shaft.

3. The device according to claim 2, in which the section with reduced diameter is a recess that is wedge-shaped and, in its locking position, prevents a movement of the stop and thus movement of the trigger as well as of the trigger bar to the front.

4. The device according to claim 1, in which the forward movement of the trigger bar enables its forced engagement with the disconnector bar and the sear.

5. The device according to claim 4, in which the trigger bar comprises at least one tab for the forced engagement.

6. The device according to claim 4, in which the sear has a projection for the active engagement with the trigger bar.

7. The device according to claim 4, in which the disconnector bar has a step for the active engagement with the trigger bar in a recess.

8. The device according to claim 1, in which the disconnector bar has an elevation on its side facing the lock slide and can be impacted upon through a lower contour of the moving lock slide.

9. The device according to claim 8, in which the lock slide has on its underside a first recess, which in the case of a closed lock can be brought into active engagement with the elevation of the disconnector bar.

10. The device according to claim 9, in which the lock slide has on its underside at least a second recess which in its slide catch position can be brought into active engagement with the elevation of the disconnector bar.

11. The device according to claim 1, in which when the disarming shaft is in the disarmed, a non-recessed region on the underside of the lock slide, in its forward movement from its slide catch position, presses the disconnector bar down, said disconnector bar in the process going into form-fitting or forced engagement with the trigger bar, bringing said trigger bar into form-fitting or forced engagement with the sear and the trigger bar brings the sear out of the path of motion of the firing pin.

12. The device according to claim 1, with a release pawl, which upon actuation of the trigger can be coupled with the trigger bar and thus disengages the sear from the lug to discharge a round.

13. A self-loading pistol with a firing pin prevention device for its disarming, comprising:

a device for prevention of the tensioning of the a firing pin spring in the disarming of a hammerless self-loading pistol provided with a lock slide, wherein the device can assume a disarming position and a locking position, the device comprising:

a spring-loadable firing pin with a lug formed thereon for active engagement with a sear, which in the locking position for cocking the firing pin spring, the sear protrudes into the path of motion of the lug and in the disarming position the sear is disengaged from the lug, a trigger bar coupled with a trigger which in the disarming position disengages the sear from the lug, a disarming shaft, which in the disarming position enables a movement of the trigger and thus the trigger bar to the front, and a disconnector bar that can be coupled to the trigger bar, said disconnector bar being impacted in the disarming position by the lock slide moved to the front and as a result operatively disengaging the sear from the lug by means of the trigger bar.

* * * * *